United States Patent [19]

Skovdal et al.

[11] Patent Number: 4,680,444

[45] Date of Patent: Jul. 14, 1987

[54] HAIRSETTER SYSTEM FOR ELECTRICALLY HEATING HAIR ROLLERS

[75] Inventors: Jorgen Skovdal, Trumbull; Daniel Santhouse, Stratford, both of Conn.; Borge Jensen, Kalundborg, Denmark; Vito Carlucci, Stratford, Conn.

[73] Assignee: Clairol Incorporated, New York, N.Y.

[21] Appl. No.: 726,865

[22] Filed: Apr. 25, 1985

[51] Int. Cl.[4] ..... H05B 3/00; A45D 2/36; H01R 13/20; H01C 7/02

[52] U.S. Cl. ..... 219/222; 132/33 R; 219/242; 219/505; 219/540; 219/541; 338/22 R

[58] Field of Search ..... 219/222–226, 219/242, 230, 504, 530, 505, 539, 540, 541, 544, 552, 553; 132/37 R, 37 A, 33 R, 33 G; 338/22 R; 339/195 R, 195 A, 195 S, 196 R, 196 A, 191 R, 65 R, 66 R

[56] References Cited

U.S. PATENT DOCUMENTS

| | | | |
|---|---|---|---|
| 2,179,861 | 11/1939 | Polis | 339/66 R |
| 2,458,203 | 1/1949 | Rohrman | 339/196 R |
| 3,398,260 | 8/1968 | Martens | 219/247 X |
| 3,473,004 | 10/1969 | Block et al. | 219/222 |
| 3,617,694 | 11/1971 | D'Entremont | 219/222 |
| 3,632,971 | 1/1972 | Flanagan | 219/222 |
| 4,147,927 | 4/1979 | Pirotte | 219/539 |
| 4,228,343 | 10/1980 | Kanner et al. | 219/225 |
| 4,284,877 | 8/1981 | Abura et al. | 219/541 |
| 4,447,705 | 5/1984 | Bullock | 219/541 X |

FOREIGN PATENT DOCUMENTS

| | | | |
|---|---|---|---|
| 2822327 | 12/1978 | Fed. Rep. of Germany | 219/222 |
| 458553 | 7/1950 | Italy | 339/195 S |
| 310335 | 12/1955 | Switzerland | 339/195 R |
| 2845965 | 4/1980 | United Kingdom | 338/22 R |

*Primary Examiner*—Anthony Bartis
*Attorney, Agent, or Firm*—G. Warzecha

[57] ABSTRACT

A hairsetter designed to heat a plurality of hair rollers to a predetermined temperature is provided with a plurality of sockets each intended to receive a single hair roller having a pair of electrical plug members axially extending from one end of the roller. The plug members are tapered along substantially their entire length and are formed as extensions of parallel longitudinally extending heat sinks engaging the sides of a PTC resistance heating element within the hair roller. Each socket is provided with a pair of contact pins. The upper portion of each pin is accessible through the top of the socket and the lower portion thereof is in contact with an electric wire to conduct power to the pin. The contact pins are separated by diametrically opposed ribs which interact with the tapered plug members to cause the hair roller to be automatically rotated as it as inserted into the socket so as to cause the plug members to firmly engage the upper portion of the contact pins.

9 Claims, 12 Drawing Figures

HAIRSETTER SYSTEM FOR ELECTRICALLY HEATING HAIR ROLLERS

BACKGROUND OF PRIOR ART

1. Field of the Invention

The invention generally relates to hairsetters used to heat one or more hair rollers to a predetermined temperature for use in setting hair. More particularly, the invention relates to a new electrical hairsetter and roller system having an electrical connecting system for supplying power to electrical heating elements within each hair roller.

2. Description of the Prior Art

Hairsetters are used to heat a plurality of hair rollers to a predetermined temperature. There are generally two types of hairsetters each depending upon the type of roller to be used. One type of hairsetter is shown in U.S. Pat. No. 3,858,029, assigned to the assignee hereof, showing a plurality of heated mounting posts, each for supporting one roller. The posts are heated by thermal conduction from a common base plate heated by a resistance wire heater. Examples of rollers which may be used with such a hairsetter are shown in U.S. Pat. Nos. 4,202,360; 3,773,057 and Re. 26,766, all assigned to the assignee hereof. Such rollers comprise a cylindrical shell having an external, hair winding portion and may be provided with a cylindrical casing concentrically aligned with the external hair winding portion and containing a heat retaining material for keeping the roller heated during use.

Another type of hairsetter and roller combination is shown in U.S. Pat. No. 4,447,705, assigned to the assignee hereof. This patent shows a roller heated by a transversely situated positive temperature coefficient (PTC) material which receives electrical power through an axial contact pin operating in conjunction with one concentric contact to complete the circuit. Such a roller requires a hairsetter having a centrally apertured socket for receiving the contact pin and its concentric contact as shown in FIG. 10 of the aforementioned U.S. Pat. No. 4,447,705. Hair rollers heated by internal PTC elements reach their operating temperature more quickly and efficiently than those heated through mounting posts. However, hair rollers using the aforementioned transverse PTC elements are generally expensive and, because of the unusual shape of the roller body, can only be molded with low temperature material. Thus, the heat available with such rollers is lower than it should be for efficient hair curling.

In view of the above, an axially aligned PTC element sandwiched between opposing electrically and thermally conductive heat sinks would enable rapid and efficient thermal distribution to the hair winding portion. Such a construction, albeit not in a hair roller, is generally shown in U.S. Pat. No. 4,147,927. However, there is no suggestion in this patent, or in the prior art of which Applicants are aware, of how to embody such an axially aligned structure in a hair roller which may be easily engaged and disengaged from a hairsetter base.

Accordingly, it is an object of this invention to provide a hair roller having an electrically insulated hair winding portion and utilizing an axially aligned PTC heating element situated between opposing electrically and thermally conductive heat sinks. It is a further object of this invention to produce such a PTC hair roller having electrical plug members integrally formed into the ends of said heat sinks. It is also an object of this invention to provide a hairsetter having at least one socket member for receiving such a PTC hair roller. It is yet another object of this invention to provide an electrical connecting system for use in such a PTC roller/hairsetter combination wherein the roller may be easily mounted as needed. It is an additional object of this invention to provide a hairsetter capable of being manufactured with relatively less flame retardant, and therefore lower cost material than prior art hairsetters. It is also an object of this invention to provide a hairsetter which utilizes an electrical connecting system which minimizes wear of contacts.

SUMMARY OF THE INVENTION

These and other objects of this invention are provided by the preferred embodiment thereof which is a unique hairsetter and roller construction utilizing an electrical connecting system for use in a hairsetter in combination with a roller having a PTC material operatively mounted within the roller between two axially aligned opposing heat sinks, the system comprising: a plug member extension integrally formed in one end of each heat sink, said plug member extension being tapered to a point of predetermined radius at the distal end thereof, said plug member having a curved surface, each said curved surface facing the other end symmetrically situated about the axis of said roller, said plug members axially aligned within a recess in one end of said roller; a socket member secured to said hairsetter for receiving both electrical plug members of a single roller; and means for completing an electrical connection between said socket member and said source of electrical power. In a further preferred embodiment of the invention, the socket member comprises a pair of concentric cylindrical portions separated by diametrically opposed ribs separating the annular space between the cylindrical portions into two symmetrical arcuate apertures and a pair of electrically conductive contact pins, one of said contact pins inserted into each of said arcuate apertures, the top end of each of said contact pins for being placed in electrical contact with one of said plug members when the roller is mounted on the socket member, the bottom end of each of said contact pins for being electrically connected to said source of electrical power.

BRIEF DESCRIPTION OF THE DRAWINGS

FIG. 8 is also a bottom plan view of FIG. 12, taken along the line 8—8 thereof, although wire 74 shown in FIG. 8 is omitted from FIG. 12 for the sake of clarity.

DESCRIPTION OF THE PREFERRED EMBODIMENT

Figure 1:
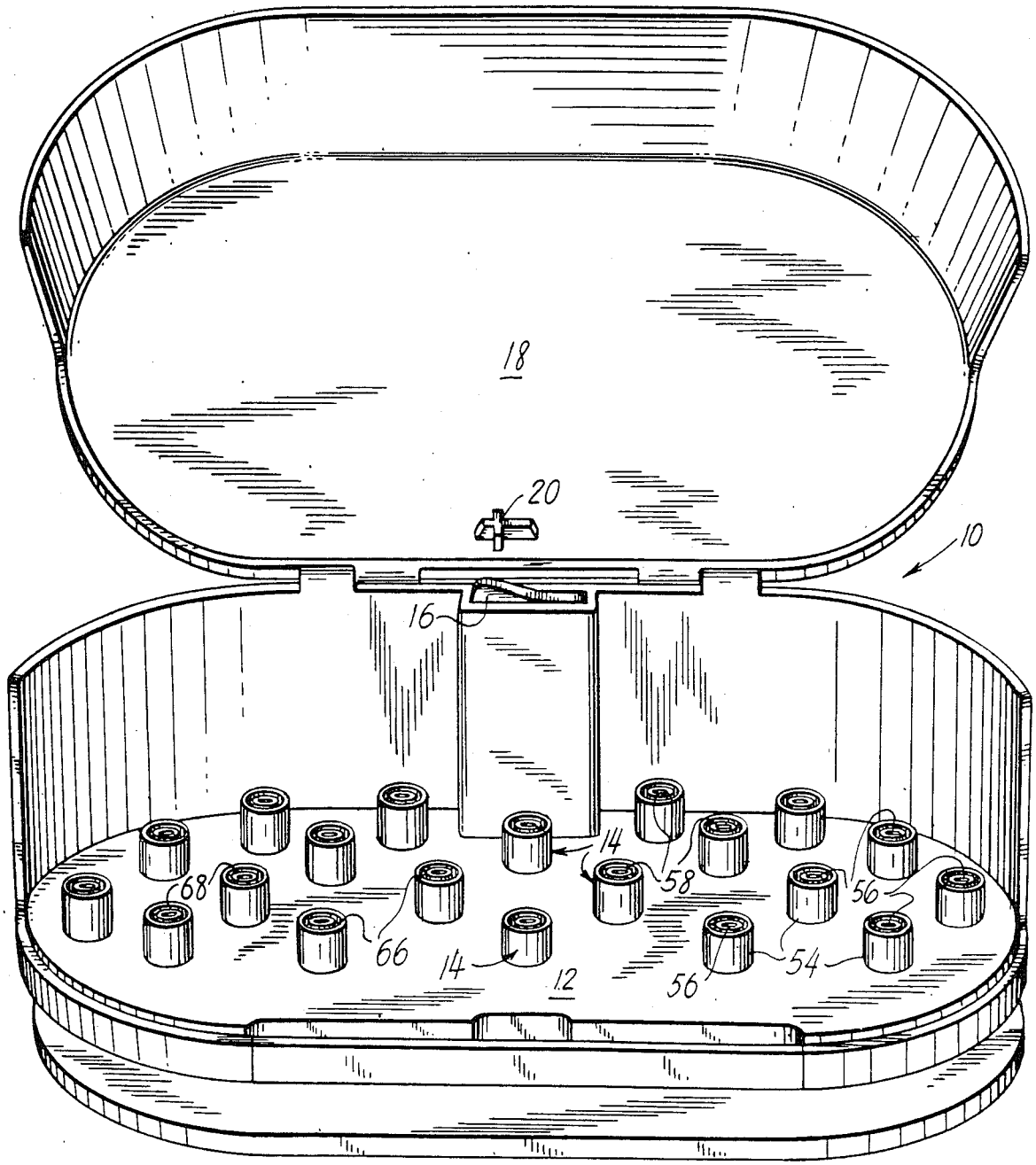
FIG. 1 shows a front perspective view of a type of hairsetter embodying the principles of this invention.

Referring now to FIG. 1 there is shown a front perspective view of hairsetter 10 constructed in accordance with the principles of this invention. Hairsetter 10 comprises a base plate 12 provided with a plurality of socket members 14 which may be integrally molded with base plate 12. Hairsetter 10 includes an on/off switch 16 and a cover 18 having a protrusion 20 for assuring that switch 16 will be "off" when the cover is closed to prevent overheating of the hairsetter. Each socket member 14 may receive any one of several different sizes of hair rollers 20, one of which is best seen in cross-section in FIG. 2. Each of the hair rollers has a commonly dimensioned recess 22 in one end although varying outer diameters 24. Socket members 14 are arranged within hairsetter 10 so that a predetermined number of various size rollers 20 may be mounted on the sockets with the cover closed.

Figure 4:
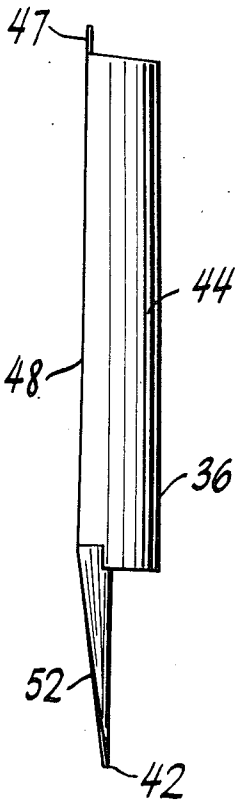
FIG. 4 shows a side elevational view of FIG. 3 taken along line 4—4 thereof.

Roller 20 comprises a hollow cylindrical hair winding portion 26 between integrally molded flanged ends 28 and 30. Hair winding portion 26 is provided with a plurality of conventional, molded bristle members 32. The interior of roller 20 contains at least one PTC element 34 pressed between two opposing heat sinks 36 and 38. PTC element 34 is retained laterally by insulated (mica) retaining plate 40 which is beneficial for proper positioning of PTC element 34. The location of plate 40 is maintained by locating pin 41 molded into the center of flange end 30. Heat sinks 36 and 38 are identical and, therefore, only one of them is shown in detail in FIGS. 3 and 4. Each heat sink is electrically conductive so that current can flow directly between them and through PTC element 34 and is provided with an integrally stamped extension which constitutes electrically conductive plug members 42. Each heat sink is also thermally conductive to facilitate heat conduction from PTC element 34 to the internal surface of hair winding portion 26. The electrical and thermal efficiency of PTC element 34 is enhanced by the spring nature of longitudinally extending spring members 44 and 46. These spring members 44 and 46 are integrally formed with flat PTC-contacting member 48 and create tension by simultaneously pressing against the internal surface of the roller and the PTC element. Each heat sink is provided with an integral tab 47 at the internal end of the heat sink. The tabs serve to space the heat sinks from each other to prevent arcing around the mica plate 40 and also serve to conduct heat to temperature "ready" dot 49 painted on the surface of flange 30.

Figure 3:
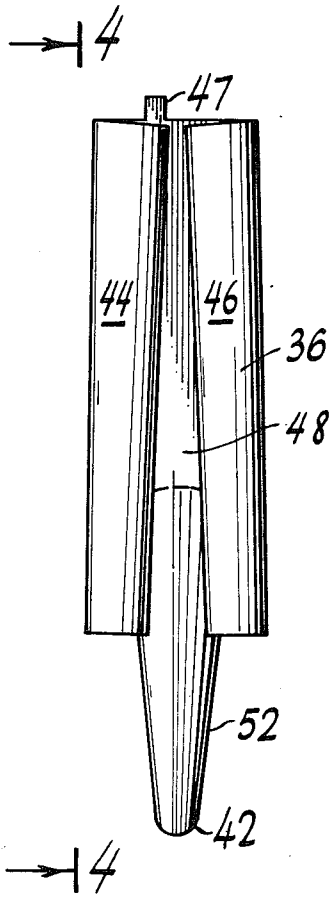
FIG. 3 shows a front elevational view of a portion of the roller shown in FIG. 2 taken along the line 3—3 thereof.

Plug members 42 extend a predetermined distance beyond the main body of the heat sink to enable an apertured end cap 50 to be inserted (and ultrasonically welded) into the open end of roller 20. End cap 50 has a predetermined depth and internal diameter to enable it to be placed on a socket 14 to retain roller 20 thereon in a stable manner. End cap 50 is provided with a reinforcing rib 51 having an expanded central portion 53. Rib 51 and portion 53 serve to protect plate 40 from damage due to accidental insertion of foreign objects into the interior of the roller. Portion 53 also aids in maintaining proper space between plug members 42 by conforming with the curved surfaces 52. Each plug member 42 is tapered to a point of predetermined radius as best seen in FIG. 3 and is curved with a concave surface 52 facing inwardly in order to enhance electrical contact to other portions of the invention as will be understood below.

Figure 2:
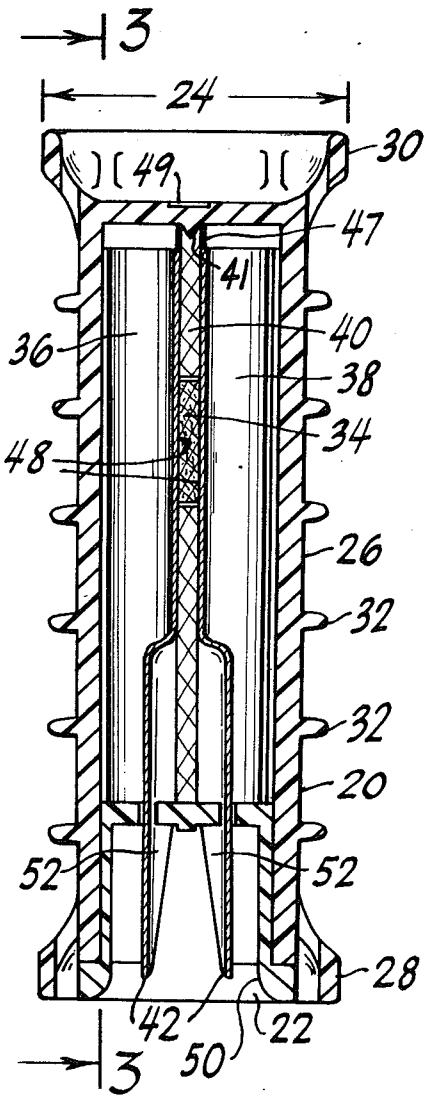
FIG. 2 shows an elevational cross-section of a hair roller embodying the principles of this invention and intended for use with the hairsetter of FIG. 1.
Figure 12:
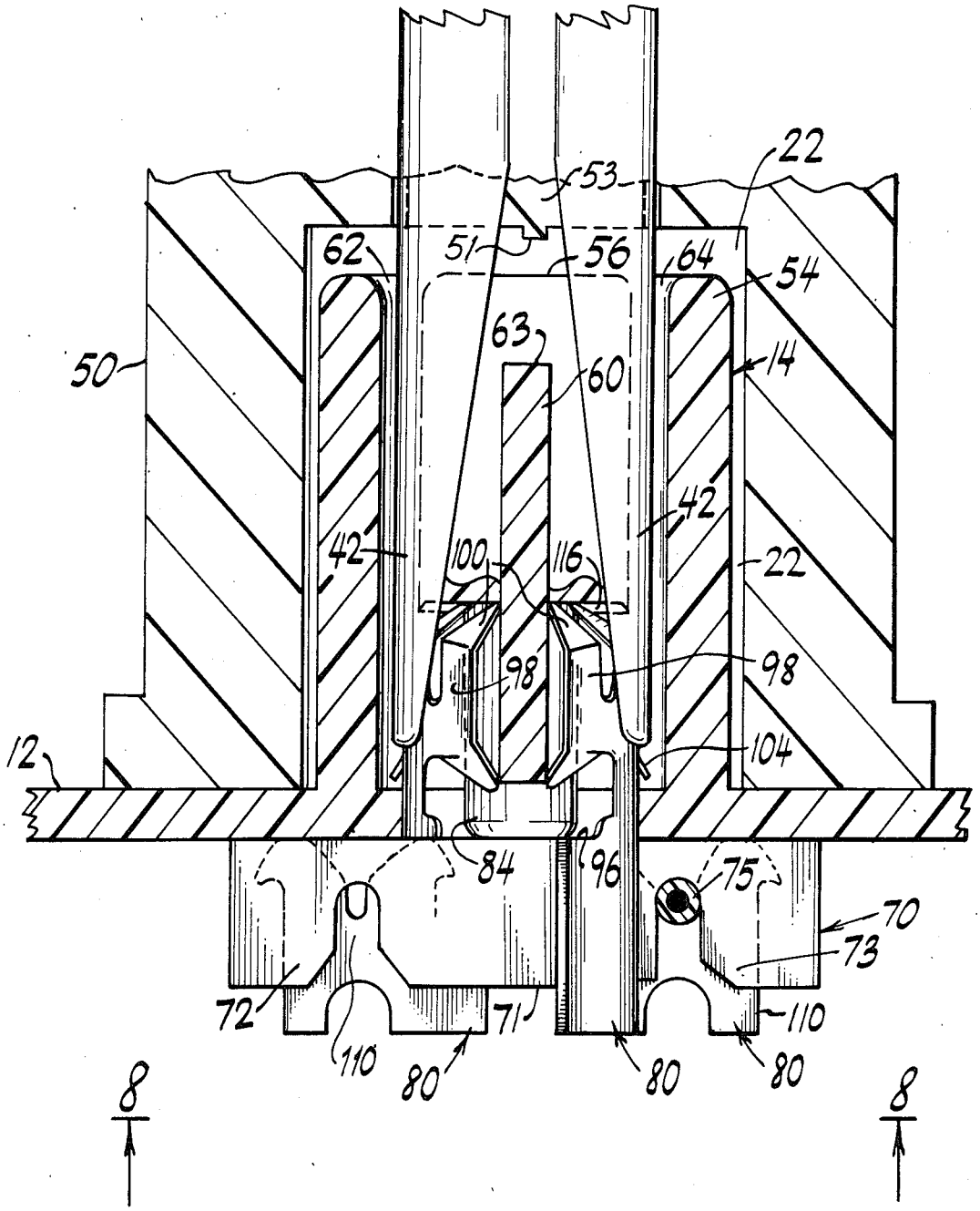
FIG. 12 shows a partially cut-away, partially cross-section elevational view of the various components of the invention assembled in an operative configuration.

The inner most, concave side of each curved surface 52 is intended to be placed in electrical contact with the radially outermost, convex surface of cylindrical portion 106 of contact pin 80, as will be better understood by reference to FIG. 12. It should be understood by those of ordinary skill in the art that the radii of curvature of the concave side of curved surface 52 and of the convex side of cylindrical portion 106 are substantially the same, as is necessary in order to enable efficient mateable electrical contact therebetween. Furthermore, it will be understood that the radius of curvature of the concave side of curved surface 52 is substantially uniform along the length of plug member 42 as best seen in FIGS. 2 and 12.

Figure 5:
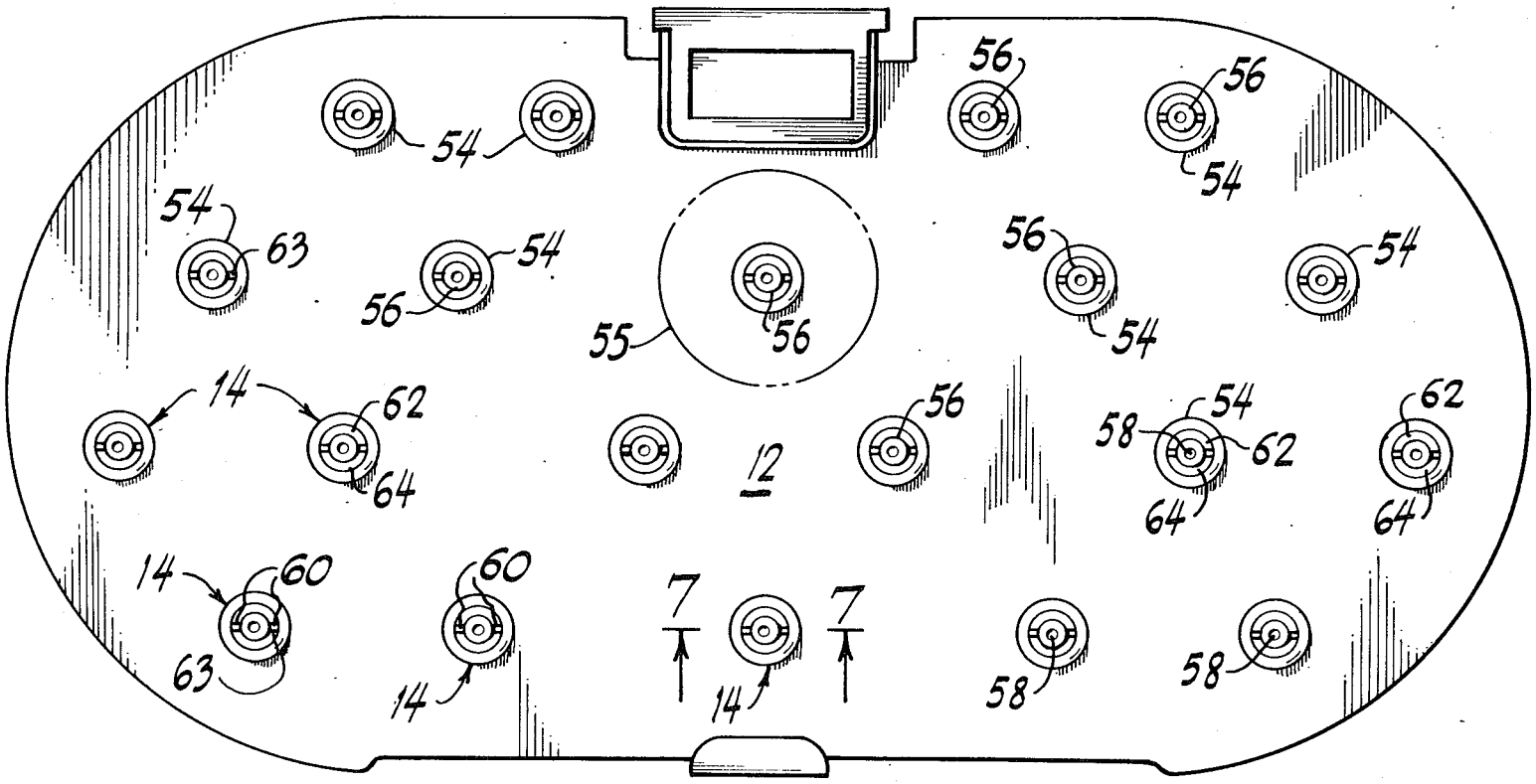
FIG. 5 shows a diametrical top plan view of the hairsetter shown in FIG. 1.

Referring now to FIG. 5 there is shown a top plan view of base plate 12 and socket members 14 (omitting some other details of FIG. 1 for clarity). The outline of the external diameter of a flanged end of a sample roller 20 (not shown) is shown in phantom at 55. Each socket member 14 (shown in greater detail in elevational cross-section in FIG. 7) comprises an outer cylindrical portion 54 and a concentrically situated inner cylindrical portion 56. Since socket members 14 are generally molded from suitable plastic material, either integrally with or separately from base plate 12, inner cylindrical portion 56 may have a shallow recess 58 to reduce material requirements. Each socket member 14 has diametrically opposed, longitudinal radially extending ribs 60 connecting inner and outer cylindrical portions 54 and 56 and separating the annular space therebetween into facing axially aligned arcuate spaces 62 and 64. It will be noted from a comparison of FIGS. 1, 5 and 7 that ribs 60 have their top ends 63 a predetermined distance below the co-planar rims 66 and 68 of cylindrical portions 54 and 56, respectively, Referring now to FIG. 6 there is shown a bottom plan view of base plate 12 showing the bottom portions 70 of each socket member 14. Since all bottom portions 70 are identical, a single one is shown in an expanded bottom plan view in FIG. 8 along with other components to be described. The bottom portions 70 may be integrally molded with the top portions and with base plate 12. Each bottom portion 70 is provided with separating ribs 71, aligned below ribs 60, each rib 71 having perpendicularly arranged wire receiving members 72 and 73 at its distal ends for receiving insulated wires 74 and 75, respectively. Ribs 71 and members 72 and 73 are beveled at 76 to facilitate insertion of electrical contact pins 80. Bottom portions 70 are each comprised of two symmetrical portions having a bore 82 therebetween. Bore 82 contributes to reduction of material requirements and facilitates installation of contacts pins 80. The bottom portion of inner cylindrical portion 56 is formed into a concentric cylindrical post 84, the function of which will be described below.

Figure 6:
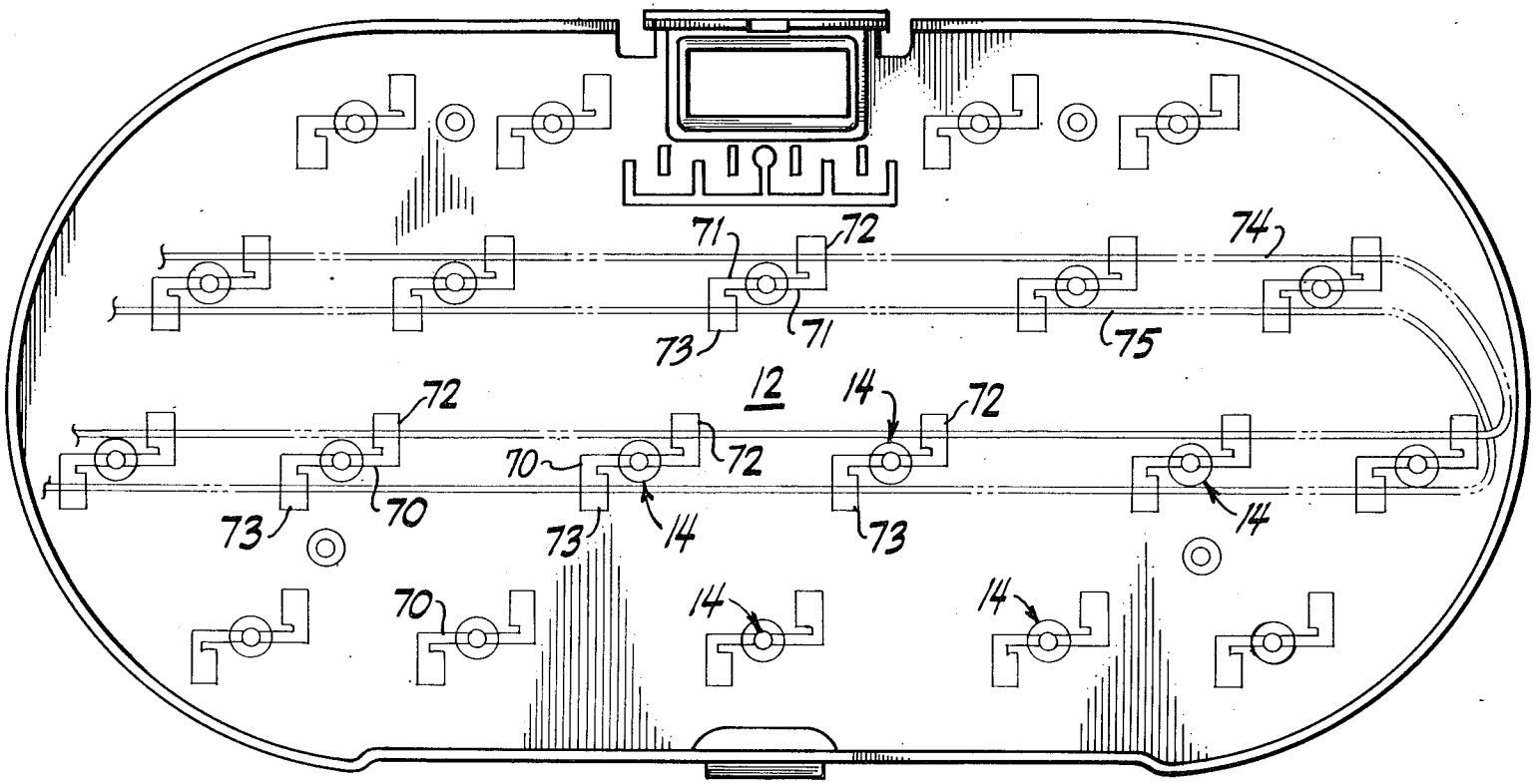
FIG. 6 shows a diametrical bottom plan view of FIG. 5.
Figure 8:
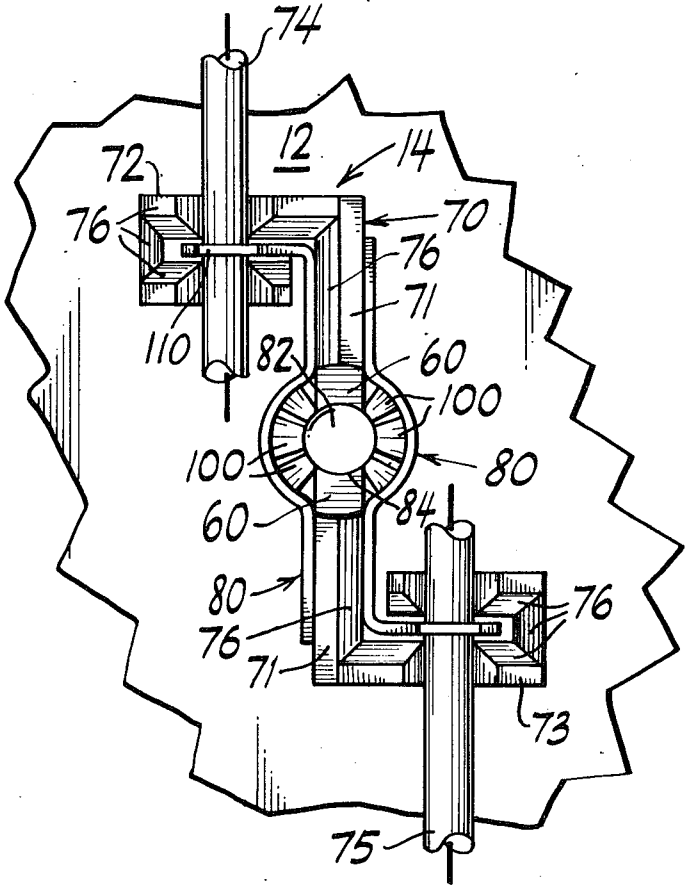
FIG. 8 shows an expanded view of the bottom portion of a single socket member shown in FIG. 6 with the addition of other components of the invention.
Figure 7:
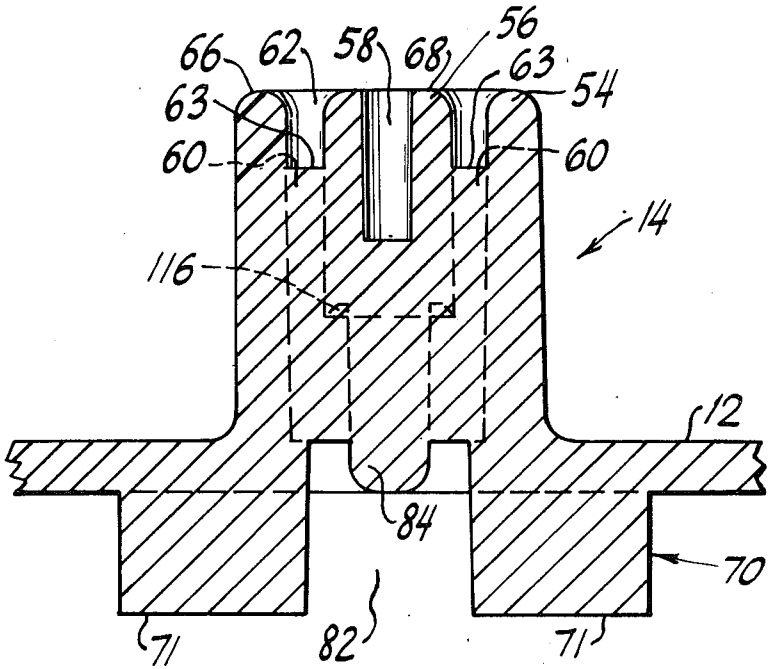
FIG. 7 shows a sectional elevational view of a socket member of the hairsetter taken along lines 7—7 of FIG. 5.

Wires 74 and 75 are shown in phantom in FIG. 6 merely to show their relationship to wire receiving members 72 and 73, respectively. (The members 72 and 73 are identical except for their association with different wires). Cut-away portions of wires 74 and 75 are shown in FIG. 8 in relation to other component parts of the invention. It will be understood by reference to FIGS. 6 and 8 that wires 74 and 75 connect sockets 14 in parallel and ultimately to a source of electrical power (not shown).

Figure 9:
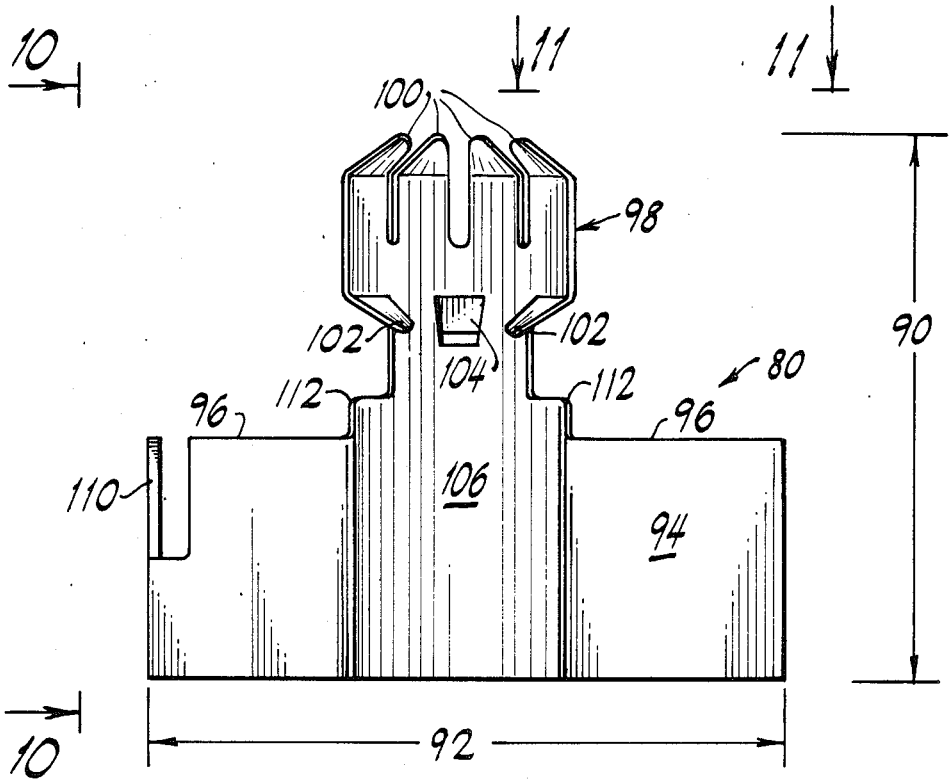
FIG. 9 shows a front elevational view of an electrical contact pin used in the invention.
Figure 10:
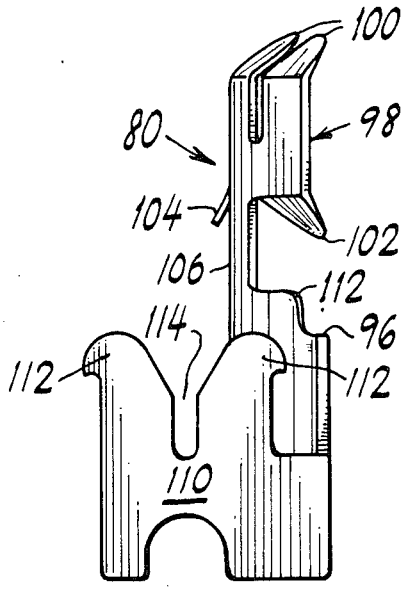
FIGS. 10 and 11 show orthogonal views of FIG. 9 taken along the lines 10—10 and 11—11, respectively.
Figure 11:
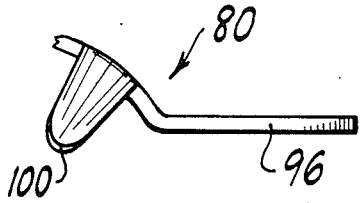

One of the contact pins 80 is shown in orthogonal views in FIGS. 9, 10 and 11. Each pin 80 is stamped from electrically conductive material into a final configuration having a predetermined height 90 and length 92 sufficient to mate with the bottom portion 70 of a socket member 14 as best seen in FIGS. 8 and 12. Each pin 80 is provided with a base portion 94, having a top edge 96, and a tined portion 98 having a plurality of radially inwardly bent top tines 100, bottom radially inwardly bent tines 102 and locking tab 104. Tined portion 98 and the central part of base portion 94 are formed into a partial cylindrical portion 106 to provide rigidity and enable mateable contact of tined portion 98 with the curved plug members 42 as will be understood below.

Contact pins 80 are each provided with a wire insulation piercing portion 110 for being received within wire receiving members 72 and 73 when pins 80 are inserted into the bottom portion 70 of socket members 14. Insulation piercing portion 110 is provided with locking tabs 112 for digging into members 72 and 73 to assist in retaining contact pins 80 in sockets 14. Ledges or shoulders 112 and tab 104 perform a similar function. Portion 110 is provided with a conventional insulation piercing slot 114.

Referring now to FIG. 12 there is shown a cut-away elevational view, partly in cross-section, of an end cap 50 of a sample roller 20 mounted on a socket 14. The view of socket 14 is a side view of FIG. 7, aligned with ribs 60 and 71 and more clearly showing arcuate spaces 62 and 64.

It will be understood that assembly of hairsetter 10 into an operative configuration requires placement of insulated wire in the wire receiving members and insertion of two contact pins into the bottom portion 70 of each socket member 14 so that the insulation is pierced and tined portions 98 extend into arcuate spaces 62 and 64 above base plate 12. The compression fit of the various parts enhances efficient manufacture since it will retain base plate 12, socket members 14, contact pins 80 and wires 72 and 74 as a unit to be placed in hairsetter 10 and connected to a source of electrical power in a manner well known to those skilled in the art. The invention also contributes to lower cost manufacture since the wires and other electrical components are hung beneath base 12 and enable the use of a support base (not shown) made of relatively less expensive less-flame retardant plastic material. Conventional electrically activated hairsetters have electrical components in the support base and in the socket base.

By reference to FIGS. 5 and 12 it will be understood that when roller 20 is mounted on a socket 14, plug members 42 will be guided, by the cooperative action of the internal diameter of recess 22 and external diameter of cylindrical portion 54, into arcuate spaces 62 and 64. The interaction of ribs 60 and the taper on plug members 42 will force roller 20 to rotate as it is pushed down on socket 14 so that the inwardly curved tips of each plug member 42 will come into firm contact with an associated one of tined portions 98 somewhere along the arcuate external surface thereof. The random (to within approximately 45°) placement of the plug members into the socket is beneficial since it limits contact wear. It will be understood that proper dimensioning and curvature of tines 100 and central post 84 will cause tined portion 98 to be biased radially outwardly to assure good electrical contact of tined portion 98 with plug member 42. Retention of this outward bias is facilitated by arcuate grooves 116 formed in the bottom of inner cylindrical portion 56 in order to receive the tips of tines 100 and prevent them from being forced radially outwardly in reaction to the pressure of plug member 42 on tined portions 98. It will be noted that engagement and disengagement of a roller 20 and a socket 14 may be thus easily accomplished.

It will be understood by those skilled in the art that numerous modifications and improvements may be made to the preferred embodiment of the invention disclosed herein without departing from the spirit and scope thereof.

What is claimed is:

1. In a hairsetter for electrically heating at least one hair roller, each said hair roller having an electrically activated internal heat generating material and a pair of plug members operatively electrically connected thereto and extending into a recess within one end of said roller, said hairsetter having at least one electrical socket member, each socket member including a pair of electrical contact pins receiving said pair of plug members, and means for completing an electrical connection between said contact pins of said socket member and a source of electrical power, the improvement wherein:

each said socket member comprises an electrically insulated socket housing for receiving the end of said roller having said recess, said housing having a first hollow cylindrical portion with an outside diameter smaller than the inside diameter of said recess and having a second cylindrical portion concentrically aligned within said first cylindrical portion in spaced relation to the inner surface thereof to form an annular space therebetween, a pair of radially extending diametrically opposed rib members connecting said first and second cylindrical portions to form the annular space therebetween into two arcuate spaces, each adapted to receive one of said plug members one of said contact pens being inserted into each of said arcuate spaces; and wherein each of said plug members is tapered to a point of predetermined radius at the distal end thereof, each said plug member having along its length a curved surface of substantially uniform radius of curvature, the concave sides of each of said curved surfaces facing each other and symmetrically situated about the longitudinal axis of said roller.

2. A hairsetter according to claim 1 wherein the improvement further comprises:

the top end of each of said contact pins having a convex surface with a predetermined radius of curvature adapted to be placed in electrical contact with one of the concave sides of the curved surfaces of said plug members when said roller is mounted on said socket member, the bottom end of each of said contact pins being electrically connected to said electrical connection completing means.

3. A hairsetter according to claim 2 wherein said electrically conductive contact pins are identical.

4. A hairsetter according to claim 2 wherein each of said electrically conductive contact pins comprises:

a top portion having a plurality of tines arranged in an arcuate relationship, the tips of said tines being radially inclined and contacting said second cylindrical portion, the outer surface of said tines being axially aligned and contacting the inner surface of one of said plug members when said roller is mounted on said socket member;

means for retaining said contact pin within its respective socket member; and a bottom portion electrically connected to said top portion, said bottom portion provided with insulation piercing means electrically connecting said bottom portion to an insulated wire operatively connected to said source of electrical power.

5. A hairsetter according to claim 4 wherein said bottom portion is integrally formed with said top portion.

6. A hairsetter system according to claim 4 wherein said electrically insulated socket housing further comprises a base portion comprising a wire receiving member receiving said insulated wire, said wire receiving member also receiving said insulation piercing means.

7. A hairsetter according to claim 6 wherein a plurality of said socket housings are provided and said socket housings are aligned so that a plurality of adjacent ones of said wire receiving members are aligned to receive said insulated wire whereby a plurality of said contact pins will be connected in series by said wire.

8. In a heatable hair roller having a hollow cylindrical hair winding portion and an electrically activated postive temperature coefficient (PTC) material within said cylindrical hair winding portion for heating said hair roller, a pair of parallel electrically and thermally conductive plates longitudinally extending within said hollow cylindrical hair winding portion, said PTC material being situated therebetween and in electrical contact therewith, each said plate having integrally formed along at least one longitudinal edge a thermally conductive longitudinal extension generally conforming to and pressing against the interior of said cylindrical hair winding portion, the improvement comprising:

a plug member extending from one end of each of said plates, each of said plug members tapered along substantially its entire length to a point of predetermined radius at its distal end and accessible from the exterior of said roller, each said plug member having along its length a concave surface of substantially uniform radius of curvature, said concave surfaces facing each other.

9. A hairsetter for electrically heating at least one hair roller having a pair of spaced and inwardly curved electrical plug members at one end thereof, said hairsetter comprising:

a base;

means for connecting said base to a source of electrical power;

at least one socket member having a pair of spaced contact pins in electrical contact with the connecting means in said base for receiving a hair roller, said socket member comprising:

an electrically insulated socket housing for receiving an end of a roller having a recess, said housing having a first cylindrical portion with an outside diameter smaller than the inside diameter of the roller recess and having a second cylindrical portion concentrically aligned within said first cylindrical portion in spaced relation thereto, a pair of radially extending and diametrically opposed rib members connecting said first and second cylindrical portions to form the annular space therebetween into two arcuate spaces; and a pair of electrically conductive contact pins, a portion of each of said contact pins inserted into a different one of said arcuate spaces, the top end of each of said contact pins adapted to be placed in electrical contact with one of the roller plug members when the roller is mounted on said socket member, the bottom end of each of said contact pins being electrically connected to said source of electrical power by said connecting means.

* * * * *